US007815132B2

(12) United States Patent
Baltz

(10) Patent No.: US 7,815,132 B2
(45) Date of Patent: Oct. 19, 2010

(54) METHOD FOR PREVENTING VOLTAGE FROM ESCAPING FLUID INTERFACE FOR WATER BASE GRAVITY FEED APPLICATORS

(75) Inventor: James P. Baltz, Waterville, OH (US)

(73) Assignee: Illinois Tool Works Inc., Glenview, IL (US)

( * ) Notice: Subject to any disclaimer, the term of this patent is extended or adjusted under 35 U.S.C. 154(b) by 9 days.

(21) Appl. No.: 12/190,317

(22) Filed: Aug. 12, 2008

(65) Prior Publication Data

US 2010/0038376 A1 Feb. 18, 2010

(51) Int. Cl.
*B05B 5/00* (2006.01)

(52) U.S. Cl. ..... 239/690; 239/345; 239/379; 239/525; 239/600

(58) Field of Classification Search ..... 239/290, 239/296, 298, 345, 376, 379, 525, 600, 690, 239/704, 707
See application file for complete search history.

(56) References Cited

U.S. PATENT DOCUMENTS

| | | | |
|---|---|---|---|
| 2,738,231 | A | 3/1956 | Kurtz |
| 3,851,618 | A | 12/1974 | Bentley |
| 3,875,892 | A | 4/1975 | Gregg et al. |
| 3,894,272 | A | 7/1975 | Bentley |
| 4,075,677 | A | 2/1978 | Bentley |
| 4,187,527 | A | 2/1980 | Bentley |
| 4,324,812 | A | 4/1982 | Bentley |
| 4,481,557 | A | 11/1984 | Woodruff |
| 4,485,427 | A | 11/1984 | Woodruff et al. |
| 4,745,520 | A | 5/1988 | Hughey |
| 4,760,962 | A | 8/1988 | Wheeler |
| 4,793,369 | A | 12/1988 | Robb et al. |
| 4,941,614 | A | 7/1990 | Ilott |
| 4,978,072 | A | 12/1990 | Kurowski |
| 5,054,687 | A | 10/1991 | Burns et al. |
| 5,119,992 | A | 6/1992 | Grime |
| 5,174,317 | A | 12/1992 | Robb et al. |
| 5,209,365 | A | 5/1993 | Wood |
| 5,267,693 | A | 12/1993 | Dickey |
| 5,366,158 | A | 11/1994 | Robisch et al. |
| 5,485,860 | A | 1/1996 | Robb et al. |

(Continued)

FOREIGN PATENT DOCUMENTS

| | | | |
|---|---|---|---|
| JP | 7-194997 | A | 8/1995 |

(Continued)

OTHER PUBLICATIONS

International search report from PCT/US2009/051520dated Sep. 9, 2009.

*Primary Examiner*—Steven J Ganey
(74) *Attorney, Agent, or Firm*—Barnes & Thornburg LLP

(57) ABSTRACT

A coating material dispensing device includes an orifice for coupling to a reservoir for the coating material. The orifice is surrounded by a surface including at least one wall defining at least one groove. The reservoir includes a complementary surface including at least one wall defining at least one groove. The at least one groove and at least one wall surrounding the orifice respectively receive and are received in the at least one wall and at least one groove of the complementary surface of the reservoir to provide a labyrinth seal between the orifice and an exterior surface of the coating material dispensing device.

14 Claims, 2 Drawing Sheets

U.S. PATENT DOCUMENTS

| | | | | |
|---|---|---|---|---|
| 5,582,350 | A | 12/1996 | Kosmyna et al. | |
| 5,803,367 | A | 9/1998 | Heard et al. | |
| 5,836,517 | A | 11/1998 | Burns et al. | |
| 5,978,244 | A | 11/1999 | Hughey | |
| 6,144,570 | A | 11/2000 | Hughey | |
| 6,189,809 | B1 | 2/2001 | Schwebemeyer | |
| 6,423,142 | B1 | 7/2002 | Hughey | |
| 6,536,687 | B1 | 3/2003 | Navis et al. | |
| 6,543,708 | B1 | 4/2003 | Stephenson, Jr. | |
| 6,562,137 | B2 | 5/2003 | Hughey | |
| 6,588,681 | B2 | 7/2003 | Rothrum et al. | |
| 6,595,441 | B2 | 7/2003 | Petrie et al. | |
| 6,663,018 | B2 | 12/2003 | Rothrum et al. | |
| 6,698,670 | B1 | 3/2004 | Gosis et al. | |
| 6,712,292 | B1 | 3/2004 | Gosis et al. | |
| 6,749,132 | B2 | 6/2004 | Pettit et al. | |
| 6,796,514 | B1 | 9/2004 | Schwartz | |
| 6,945,429 | B2 | 9/2005 | Gosis et al. | |
| 6,953,155 | B2 | 10/2005 | Joseph et al. | |
| 7,032,839 | B2 * | 4/2006 | Blette et al. | 239/290 |
| 7,086,549 | B2 | 8/2006 | Kosmyna et al. | |
| 7,090,148 | B2 | 8/2006 | Petrie et al. | |
| 7,143,960 | B2 | 12/2006 | Joseph et al. | |
| 7,165,732 | B2 | 1/2007 | Kosmyna et al. | |
| D545,943 | S | 7/2007 | Rodgers et al. | |
| 7,296,759 | B2 | 11/2007 | Alexander et al. | |
| 7,296,760 | B2 | 11/2007 | Alexander et al. | |
| 7,344,040 | B2 | 3/2008 | Kosmyna et al. | |
| 7,350,418 | B2 | 4/2008 | Kosmyna et al. | |
| 7,350,723 | B2 | 4/2008 | Reedy | |
| 7,353,964 | B2 | 4/2008 | Kosmyna | |
| 7,354,074 | B2 | 4/2008 | Kosmyna et al. | |
| 7,364,098 | B2 | 4/2008 | Alexander et al. | |
| 7,380,680 | B2 | 6/2008 | Kosmyna et al. | |
| 7,484,676 | B2 * | 2/2009 | Joseph et al. | 239/345 |
| 2004/0065755 | A1 | 4/2004 | Turnbull | |
| 2006/0202060 | A1 | 9/2006 | Alexander | |
| 2006/0283386 | A1 | 12/2006 | Alexander et al. | |
| 2007/0034268 | A1 | 2/2007 | Baltz | |
| 2007/0080243 | A1 | 4/2007 | Alexander et al. | |

FOREIGN PATENT DOCUMENTS

| | | | |
|---|---|---|---|
| JP | 9-70557 | A | 3/1997 |
| JP | 9-187682 | A | 7/1997 |
| JP | 11-31941 | A | 11/1999 |
| JP | 2005-288212 | A | 10/2005 |

* cited by examiner

METHOD FOR PREVENTING VOLTAGE FROM ESCAPING FLUID INTERFACE FOR WATER BASE GRAVITY FEED APPLICATORS

FIELD OF THE INVENTION

This invention relates to dispensing devices for dispensing coating materials. Such devices are sometimes referred to hereinafter as spray guns or guns.

BACKGROUND OF THE INVENTION

Many types of spray guns for the dispensing of coating materials (hereinafter sometimes paint) are known. There are, for example, the devices illustrated and described in U.S. Pat. Nos. 7,380,680; 7,354,074; 7,353,964; 7,350,418; 7,344,040; 7,165,732; 7,143,960; 7,090,148; 7,086,549; 6,953,155; 6,945,429; 6,796,514; 6,749,132; 6,712,292; 6,698,670; 6,663,018; 6,595,441; 6,543,708; 6,536,687; 6,588,681; 6,189,809; 5,836,517; 5,803,367; 5,582,350; 5,485,860; 5,366,158; 5,267,693; 5,209,365; 5,174,317; 5,119,992; 5,054,687; 4,978,072; 4,941,614; 4,793,369; 4,760,962; 4,746,063; and references cited in these; and JP H07-194997-A; JP H09-70557-A; JP H09-187682-A; and JP H11-319641-A. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

Many of these types of devices are used in facilities that repair the finishes of, for example, automotive vehicles. Automobile body shops are examples of such facilities. It is typical in such facilities that smaller amounts of coating materials are used than in, for example, an automobile finishing line in a manufacturing facility. As a result, typically, the spray guns that are used in such repair facilities are equipped with paint cups into which an amount of paint necessary to effect a repair is placed, and from which the paint flows or is drawn as paint is sprayed during the repair process. If more paint is needed, the repair is interrupted and additional paint is added as many times as are necessary to complete the repair. The guns typically one of two types: pressure or suction feed guns, in which cases the paint cup is mounted under the gun and a feed tube or siphon projects into the volume of paint in the cup to withdraw paint as the paint is being dispensed; and, gravity feed guns, in which case the cup is mounted on top of the gun and the paint flows from the cup into the gun under the influence of gravity when the gun trigger is actuated to be delivered to the gun's spray nozzle and dispensed.

In many cases, such guns are provided with, or coupled to, high-magnitude electrostatic potential sources which supply high-magnitude electrostatic potentials to electrodes with which the guns are equipped. The high-magnitude potential aids in atomization and dispensing of the coating material in accordance with know principles and results in more efficient deposition of the sprayed coating material on the object, or target, repair of which is being effected.

Finally, in many cases, the guns dispense water-base coating materials. Such materials generally are electrically non-insulative. Consequently, protection against leakage of charging voltage from the electrodes of such guns through the water-base coating materials being dispensed by such guns to ground is an issue which must be dealt with in gun design and construction.

DISCLOSURE OF THE INVENTION

According to an aspect of the invention, a coating material dispensing device includes an orifice for coupling to a reservoir for the coating material. The orifice is surrounded by a surface including at least one wall defining at least one groove. The reservoir includes a complementary surface including at least one wall defining at least one groove. The at least one groove and at least one wall surrounding the orifice respectively receive and are received in the at least one wall and at least one groove of the complementary surface of the reservoir. This configuration lengthens a path defined between: the at least one groove surrounding the orifice and the at least one wall of the reservoir received in the at least one groove surrounding the orifice; and, the at least one wall surrounding the orifice and the at least one groove of the complementary surface of the reservoir receiving the at least one wall surrounding the orifice. Lengthening this path increases the distance between the orifice and an exterior surface of the coating material dispensing device.

According to another aspect of the invention, a coating material dispensing device includes an orifice for coupling to a reservoir for the coating material. The orifice is surrounded by a surface including at least one wall defining at least one groove. The reservoir includes a complementary surface including at least one wall defining at least one groove. The at least one groove and at least one wall surrounding the orifice respectively receive and are received in the at least one wall and at least one groove of the complementary surface of the reservoir. This configuration provides a labyrinth seal between the orifice and an exterior surface of the coating material dispensing device.

Illustratively, the apparatus further including a first threaded portion adjacent the orifice and a complementary second threaded portion on the reservoir, engagement of the first and second threaded portions mounting the reservoir on the dispensing device.

Further illustratively, the first and second threaded portions lie between the walls and the exterior surface.

Additionally illustratively, the reservoir comprises a gravity-feed reservoir.

Illustratively, the dispensing device comprises a hand-held dispensing device including a trigger manipulable to control dispensing of coating material from the dispensing device.

Further illustratively, the apparatus includes a port adapted to be coupled to a source of compressed gas or mixture of gases for aiding in atomization and dispensing of the coating material from the dispensing device.

Additionally illustratively, the apparatus includes a port adapted to be coupled to a source of electrical potential for providing high-magnitude electrostatic potential for aiding in atomization dispensing of the coating material from the dispensing device.

BRIEF DESCRIPTION OF THE DRAWINGS

The invention may best be understood by referring to the following detailed descriptions and accompanying drawings which illustrate the invention. In the drawings.

DESCRIPTION OF ILLUSTRATIVE EMBODIMENTS

Figure 1:
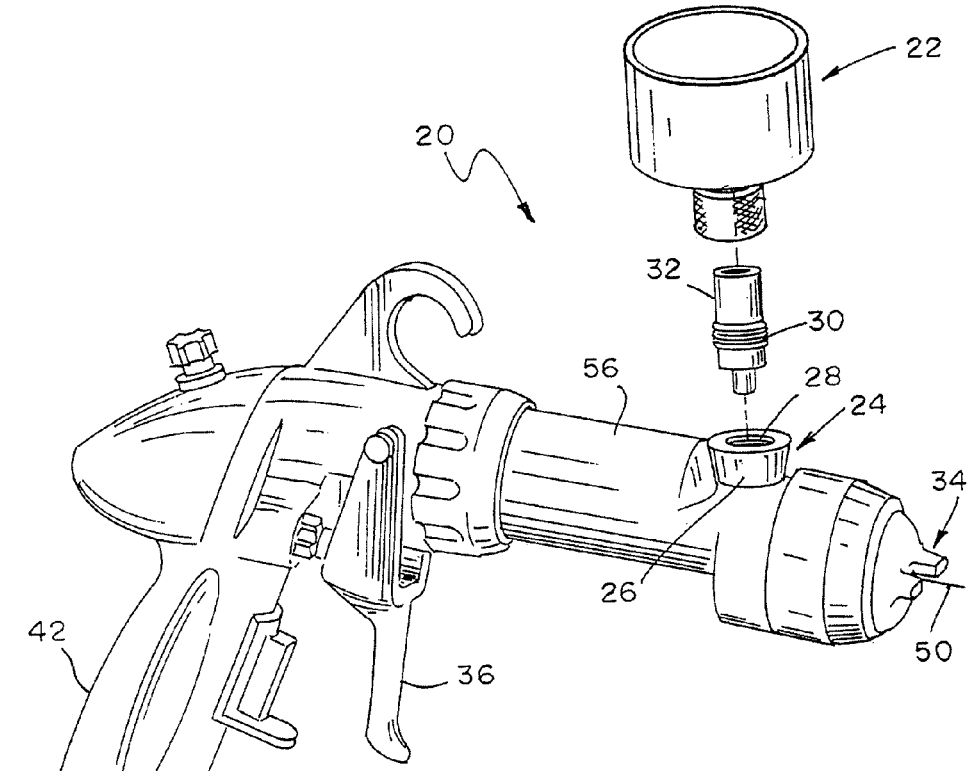
FIG. 1 illustrates a fragmentary perspective view of an embodiment.
Figure 2:
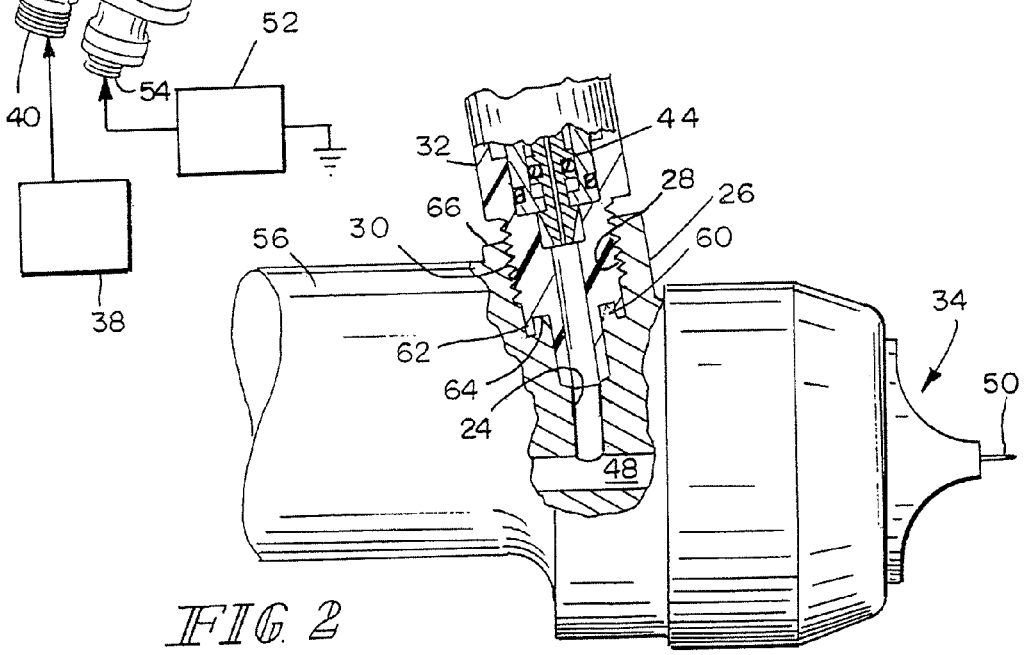
FIG. 2 illustrates a fragmentary partial sectional side elevational view of details of the embodiment illustrated in FIG. 1.

FIGS. 1-2 illustrate a gravity-feed paint cup spray gun 20 is a gun of the general type described in, for example, U.S. Pat. Nos. 7,364,098; 7,296,760; 7,296,759; D545,943; and published U. S. Patent applications: 2006/0283386; 2006/0202060. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred. The guns illustrated in these references are Vector™ guns available from ITW Ransburg, 320 Phillips Avenue, Toledo, Ohio 43612. However, rather than being the type illustrated in these references in which paint is supplied from a remote paint source through a delivery conduit of some suitable type, the gun 20 illustrated in the present application is a gravity-feed paint cup type gun 20.

A paint cup 22 constructed according to the invention is provided for coupling to an orifice 24 provided for this purpose in the upper forward end 26 of a paint spray gun 20. The orifice 24 includes a threaded portion 28 for cooperating with complementary threads 30 on the outside of a neck 32 which extends downward from an underside of the paint cup 22 to provide a flow of the paint from the paint cup to the nozzle 34 of the gun 20 when the trigger 36 of the gun 20 is actuated, opening a paint valve (not shown) at the front of gun 20. A source 38 of compressed gas or mixture of gases, illustratively compressed air, delivers compressed gas through a port 40 provided in the handle 42 of gun 20, from which point the compressed gas is delivered forward to the nozzle 34 to aid in atomizing the paint which is delivered from the paint cup 22, in accordance with known principles.

When an operator actuates the trigger 36 starting the flow of compressed gas forward from port 40 toward nozzle 34, indicating paint is to be sprayed, (a) valve(s) 44 in neck 32 senses the resulting pressure change and opens, providing a flow of paint from paint cup 22 through valve(s) 44 into a forwardly extending paint passageway 48 in the forward end 26 of the gun 20. The paint is atomized from the nozzle 34 and essentially simultaneously charged from an electrode 50 which is coupled, illustratively through the paint valve operating needle (not shown) coupled to trigger 36, to a source 52 of high-magnitude electrostatic potential. The source 52 may, for example, include a low-magnitude (for example, ±24 VDC) conductor coupled through an electrical port 54 provided on the handle 42 of the gun 20, and an oscillator, step-up transformer and Cockcroft-Walton multiplier in the barrel 56 of gun 20. Such sources are described in, for example, the above-noted U.S. Pat. Nos. 7,364,098; 7,296,760; 7,296,759; and published U.S. Patent applications: 2006/0283386; 2006/0202060. The source 52 may also be one which produces high-magnitude potential external to gun 20 and supplies the high-magnitude potential through a suitable high-voltage cable coupled to port 54. Sources of this general type are described in, for example, U.S. Pat. Nos. 6,562,137; 6,423,142; 6,144,570; 5,978,244; 4,745,520; 4,485,427; 4,481,557; 4,324,812; 4,187,527; 4,075,677; 3,894,272; 3,875,892; and, 3,851,618. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

Figure 3:
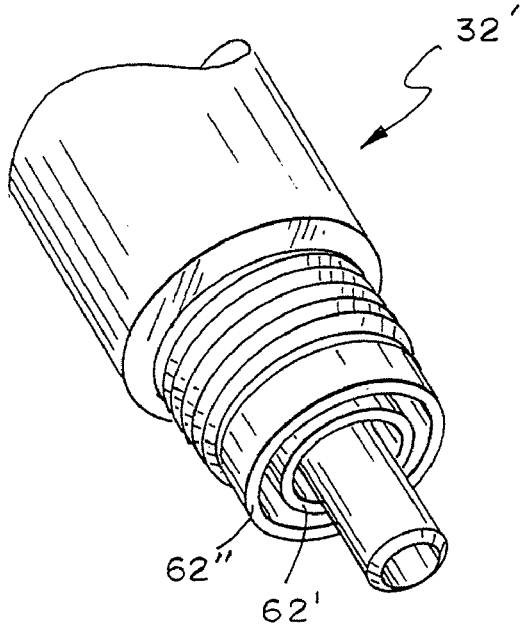
FIG. 3 illustrates a fragmentary perspective view of another embodiment; and, FIG. 4 illustrates a fragmentary partial sectional side elevational view of details of the embodiment illustrated in FIG. 3.
Figure 4:
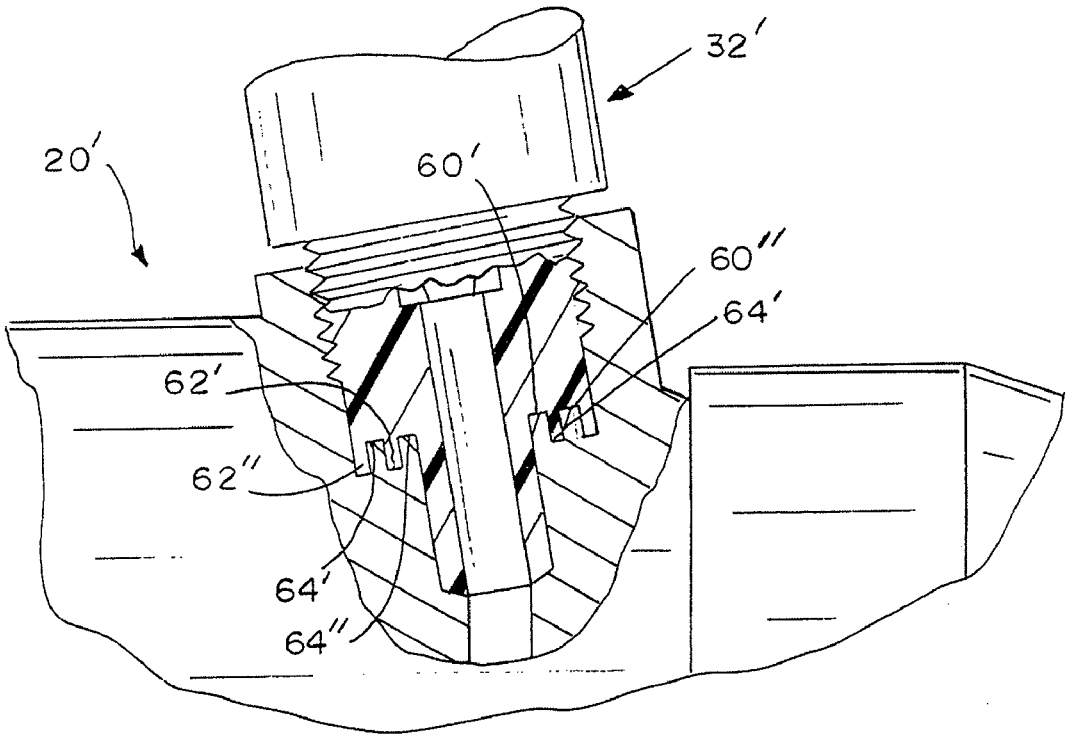

At its lower end where it engages the orifice 24, the neck 32 is configured complementary to the orifice 24. Specifically, the area of the barrel 56 around the orifice 24 and the area of the neck 32 which engages it are provided with upstanding walls 60, 62, respectively. Wall 60 nests within a groove 64 defined between wall 62 and neck 32, and wall 62 nests within a groove 64 defined between wall 60 and barrel 56. This configuration provides a labyrinthine pathway which paint, and the voltage on the column of paint in passageway 48, must traverse to escape past complementary threads 28, 30 and reach the outside surface 66 of the gun 20. In another embodiment illustrated in FIGS. 3-4, each of the gun 20' and neck 32' is provided with two walls 60', 60" and 62', 62", respectively, defining between them grooves 64' for receiving the respective walls 62', 62" or 60', 60" of the other of the neck 32' and gun 20'. Any desired number of complementary walls providing any desired number of complementary grooves to block escape of any desired magnitude of voltage may be incorporated into such a labyrinthine gun and paint orifice arrangement.

What is claimed is:

1. A coating material dispensing device including an orifice for coupling to a reservoir for the coating material, the orifice surrounded by a surface including a plurality of first walls defining a plurality of first grooves, the reservoir including a complementary surface including a plurality of second walls defining a plurality of second grooves, the plurality of first grooves and plurality of first walls surrounding the orifice respectively receiving and being received in the plurality of second walls and plurality of second grooves of the complementary surface of the reservoir to lengthen a path defined between the orifice and an exterior surface of the coating material dispensing device.

2. The apparatus of claim 1 further including a first threaded portion adjacent the orifice and a complementary second threaded portion on the reservoir, engagement of the first and second threaded portions mounting the reservoir on the dispensing device.

3. The apparatus of claim 2 wherein the first and second threaded portions lie between the walls and the exterior surface.

4. The apparatus of claim 1 wherein the reservoir comprises a gravity-feed reservoir.

5. The apparatus of claim 1 wherein the dispensing device comprises a hand-held dispensing device including a trigger manipulable to control dispensing of coating material from the dispensing device.

6. The apparatus of claim 1 including a port adapted to be coupled to a source of compressed gas or mixture of gases for aiding in atomization and dispensing of the coating material from the dispensing device.

7. The apparatus of claim 1 including a port adapted to be coupled to a source of electrical potential for providing high-magnitude electrostatic potential for aiding in atomization dispensing of the coating material from the dispensing device.

8. A coating material dispensing device including an orifice for coupling to a reservoir for the coating material, the orifice surrounded by a surface including a plurality of first walls defining a plurality of first grooves, the reservoir including a complementary surface including a plurality of second walls defining a plurality of second grooves, the plurality of first grooves and plurality of first walls surrounding the orifice respectively receiving and being received in the plurality of second walls and plurality of second grooves of the complementary surface of the reservoir to provide a labyrinth seal between the orifice and an exterior surface of the coating material dispensing device.

9. The apparatus of claim 8 further including a first threaded portion adjacent the orifice and a complementary second threaded portion on the reservoir, engagement of the first and second threaded portions mounting the reservoir on the dispensing device.

10. The apparatus of claim 9 wherein the first and second threaded portions lie between the walls and the exterior surface.

11. The apparatus of claim 8 wherein the reservoir comprises a gravity-feed reservoir.

12. The apparatus of claim 8 wherein the dispensing device comprises a hand-held dispensing device including a trigger manipulable to control dispensing of coating material from the dispensing device.

13. The apparatus of claim 8 including a port adapted to be coupled to a source of compressed gas or mixture of gases for aiding in atomization and dispensing of the coating material from the dispensing device.

14. The apparatus of claim 8 including a port adapted to be coupled to a source of electrical potential for providing high-magnitude electrostatic potential for aiding in atomization dispensing of the coating material from the dispensing device.

* * * * *